US011072448B1

(12) United States Patent
Thomson

(10) Patent No.: US 11,072,448 B1
(45) Date of Patent: Jul. 27, 2021

(54) DYNAMIC LOADING DEVICE

(71) Applicant: Alistair Thomson, Plainsville, MA (US)

(72) Inventor: Alistair Thomson, Plainsville, MA (US)

( * ) Notice: Subject to any disclaimer, the term of this patent is extended or adjusted under 35 U.S.C. 154(b) by 224 days.

(21) Appl. No.: 15/806,462

(22) Filed: Nov. 8, 2017

(51) Int. Cl.

| | |
|---|---|
| ***B65B 59/02*** | (2006.01) |
| ***B65B 35/50*** | (2006.01) |
| ***B65B 9/04*** | (2006.01) |
| ***B65B 47/10*** | (2006.01) |
| ***B65B 25/06*** | (2006.01) |

(52) U.S. Cl.
CPC ..... *B65B 59/02* (2013.01); *B65B 9/04* (2013.01); *B65B 25/065* (2013.01); *B65B 35/50* (2013.01); *B65B 47/10* (2013.01)

(58) Field of Classification Search
None
See application file for complete search history.

(56) References Cited

U.S. PATENT DOCUMENTS 4,034,536 A * 7/1977 Mahaffy ..... B29C 51/22 53/433
5,414,978 A * 5/1995 Limousin ..... B65B 9/213 53/500
8,402,723 B2 * 3/2013 Granili ..... B65B 31/028 53/427
2011/0083401 A1 * 4/2011 Scheibel ..... B65B 9/04 53/420
2015/0040521 A1 * 2/2015 Hubner ..... B65B 9/04 53/513
2016/0046063 A1 * 2/2016 Baur ..... B65B 47/10 264/318
2016/0176598 A1 * 6/2016 Palumbo ..... B65D 81/2038 206/497
2019/0210748 A1 * 7/2019 Cere ..... B65B 11/025

* cited by examiner

*Primary Examiner* — Hemant Desai
*Assistant Examiner* — Tanzim Imam

(57) ABSTRACT

This invention relates to a dynamic loading device for horizontal form, fill and seal machine ("HFFS") and in particular the loading of fresh hamburger patties into a package in an HFFS machine and sealing of said package. This invention involves a dynamic loading device in a form, fill and seal machine for packaging and stacking fresh meat patties. The HFFS machine involves opposing rolls of film wherein the bottom film is drawn to form a package or pocket for food product. The product is dropped into the pocket by a shuttle conveyor while a cylinder raises the base of the pocket to minimize the product drop into the precisely dimensioned pocket. After the product is placed in the package, an upper film is introduced for covering. Before the cover is sealed, the package is generally evacuated of atmosphere. The package is then sealed by the opposing rolls of film.

6 Claims, 4 Drawing Sheets

DYNAMIC LOADING DEVICE

CROSS REFERENCE TO RELATED APPLICATIONS

Not Applicable.

STATEMENT REGARDING FEDERALLY SPONSORED RESEARCH OR DEVELOPMENT

Not Applicable

PARTIES TO A JOINT RESEARCH AGREEMENT

Not Applicable

FIELD OF THE INVENTION

This invention relates to a horizontal form, fill and seal machine ("HFFS") and in particular a dynamic loading device involving the loading of fresh hamburger patties into a package and the sealing of said package.

BACKGROUND OF THE INVENTION

This invention involves a dynamic loading device in a form, fill and seal machine for packaging fresh patties. The horizontal form, fill and seal machine involves opposing rolls of film wherein the bottom film is drawn to form a package or pocket for food product. The device of this invention precisely deposits a difficult to load product at a high speed into a package. After the product is stacked in the package, an upper film is introduced for covering. Before the cover is sealed, the package is generally evacuated of atmosphere. Often it is also flushed with modified atmosphere to extend shelf life. The package is then sealed by the opposing rolls of film.

The prior art includes U.S. Pat. No. 5,565,261 to Kiner wherein articles are resiliently compressed when filled into a continuous plastic film tube. The patent is concerned mainly with a continuous motion process.

U.S. Pat. No. 6,119,435 to Fujiwara, et al, discloses a pillow type packaging apparatus with a suction belt for conveying flexible continuous sheet material which is formed into a tube. An inserter inserts an article into the tube which is formed into a packaging bag by cutting and sealing.

U.S. Pat. No. 6,986,236 to Schneider, et al, discloses a horizontal form, fill and seal machine which has a hollow forming box into which a continuous film is longitudinally fed from a packaging film supply. The forming box transforms the flat packaging film into a film envelope that extends about the guide bars and has a product receiving surface that rests on a conveyor between the guide bars. The patent references packaging large shaped products such as chunks of cheese, cheese slices or various products that are contained in a tray such as cookies and crackers.

U.S. Pat. No. 4,876,842 to Ausnit, discloses a form, fill and seal machine wherein product masses are deposited on a continuous length of packaging film. The product masses are wrapped in the film and the film wrap is sealed between the product masses into individual packages.

U.S. Pat. No. 5,408,806 to Lin, et al, discloses a horizontal packing machine with an adjustable pouch former.

U.S. Pat. No. 5,377,478 to Kovacs, et al, discloses a system for enveloping items such as collections of rolls in plastic film for a later downstream packaging completion.

U.S. Pat. No. 3,946,855 to Weil, discloses a device for delivering items such as stacks of cheese slices from an intermittently operating feed device to a rapidly and regularly operating packaging machine Most of the prior art patents relate to conventional form, fill and seal machines and products which are firm and differ substantially from the fresh patties that the present invention is designed to stack and package. It is extremely difficult to package fresh patties into a stack in view of the drop involved. None of the prior art patents address this problem.

SUMMARY OF INVENTION

This invention relates to a lifting device below the pocket of a form, fill and seal machine ("HFFS") in a confirmation station. The device creates a suitable artificial landing spot in the package and then settles the product into a proper depth for stacked packaging. Typically, when loading a product pocket in an HFFS machine the following steps occur; a roll of film is heated and then blown into a specific depth configuration in a die station called a forming station. The formed pocket is then indexed into the next area called the loading zone. With difficult to load products such as patty stacks, the pocket is sucked against the wall by an artificially created vacuum. The product is loaded while the film is sucked to the wall. This is called a confirmation station as it confirms the pocket size while loading. Otherwise, the film is loose and dropping product into an irregular pocket is difficult, especially when clearance between the package and product is tight.

In the case of fresh patties, the depth of the patty drop is an issue. If the product is tilted at all it will not land cleanly into the pocket. The invention involves artificially creating a new landing spot in the pocket which is accomplished by a platen of plastic under the film. The platen rises or lowers within the confirmation station via an air cylinder to the level of the top of the package. The film rests on top of the platen. This allows the shuttle conveyor to drop the stack onto a flat level surface much closer to the conveyor than the bottom of the package would be in a standard machine. The elevated platen shortens the distance the product must fall and provides a regular surface for landing in the package. Thus, it is possible to create a high fault free stack of patties.

Accordingly, it is an object of this invention to provide a new and improved loading arrangement to stack fresh meat patties and the like in a form, fill, and seal machine.

It is another object of this invention to provide an adjustable landing surface in a package for product in an HFFS machine.

It is a further object of this invention to provide a new and improved dynamic loading device for patties being packaged in stacks in an HFFS machine.

A more specific object of this invention is to provide a reciprocating platen of plastic which is positioned under the film cover and rises or lowers with the confirmation station via an air cylinder to the level of the top of the package to minimize the drop which the product experiences from a conveyor in loading zone.

BRIEF DESCRIPTION OF DRAWINGS

The above and other objects of this invention may be more clearly seen when viewed in conjunction with the accompanying drawings wherein.

DETAILED DESCRIPTION OF THE INVENTION

Figure 1:
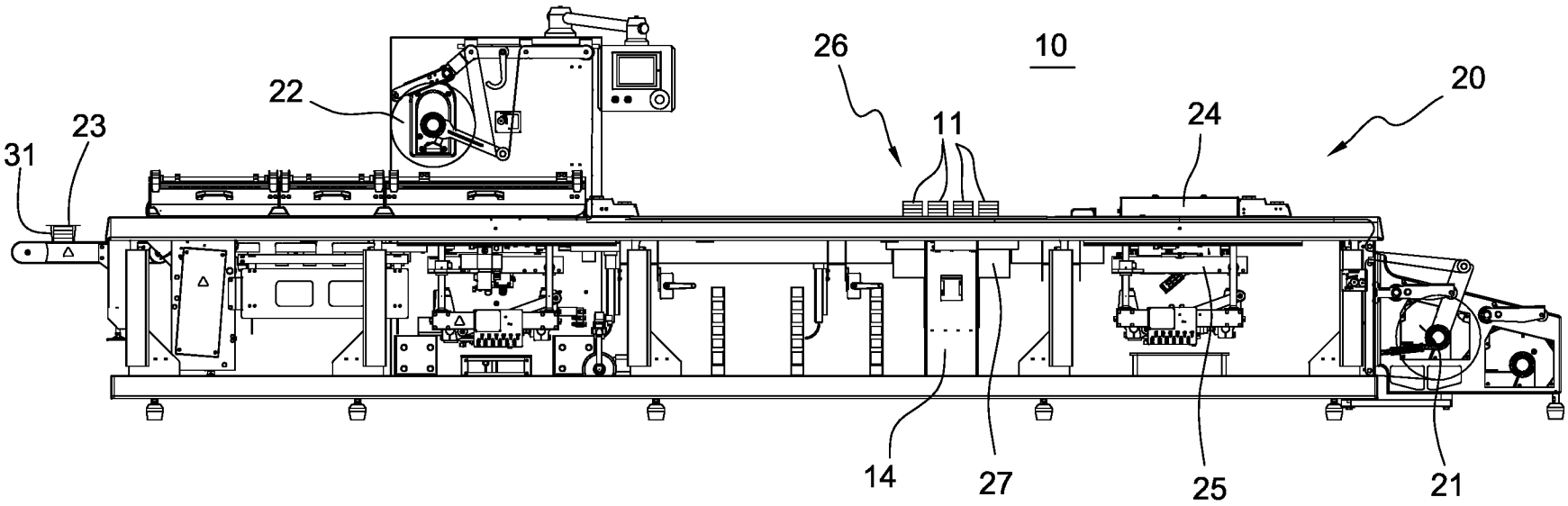
FIG. 1 is a schematic view of the dynamic loading device of this invention.

Referring to FIG. 1 of the drawings, this invention relates to a horizontal form fill and seal machine (HFFS) 10 and particularly to a device 20 for stacking fresh hamburger patties 11 in an HFFS machine package from reciprocating or shuttle conveyors (not shown). This invention solves the problems associated with a high rate of loading, a tall product stack and a difficult product.

In a HFFS machine 10, two rolls of film 21 and 22 are used to seal a package 23. The lower roll 21 is deep drawn to form a package 23 for the patties 11 with pockets 31. After the product is placed in the package 23 an upper film 22 is introduced for covering. Generally the package is evacuated of atmosphere and then sealed.

This invention involves a lifting device 14 below the pocket 31 which creates an artificial landing spot in the package 23 to settle the product at a convenient depth without harm to the product during stacking. This is particularly important when the product is hamburger patties.

In a typical HFFS machine 20 as shown in the prior art, a roll of film 22 is heated by heater 24 and then blown to a specific depth and configuration in a die station called a forming station 25. The formed pocket 31 is then indexed into the next area called the loading zone 26 where product 11 is introduced. With difficult to load products like patty stacks, the pocket 31 is sucked against a wall by an artificially created vacuum. The product 11 is loaded while the film 21 adheres to the wall. This area is called a confirmation station 27 since it confirms the pocket size while loading. Otherwise the film is loose and dropping product 11 into an irregular pocket 31 is difficult particularly where the clearance between the package 23 and product is tight.

The depth of the patty drop into the pocket 31 creates difficulties since if the product 11 tilts it will not load cleanly into the pocket 31. A plastic platen or spacer 13 is used in this invention to create an adjustable landing spot for the product. The platen 13 is positioned under the film 21 in the pocket 31 and an air cylinder 14 raises the confirmation station box 1 to a level at the top of the package 23. The film 21 rests on top of the platen 13. This allows a shuttle conveyor (not shown) to drop the product onto a flat level surface much closer to the conveyor than the bottom of the package 23 would be in a standard machine. The elevated platen 13 shortens the distance the product 28 must fall and provides a convenient surface for landing patties 11. The height of the platen 13 can be varied to minimize the negative effects of the drop. After the drop, the platen 13 is lowered along with the confirmation station box 1. The film and patty stack are also lowered. The stack settles to the bottom of the package 23 in a straight aligned fashion. A tightly packed aligned package is desirable for appearance and more importantly the uniformity is advantageous for further packaging and shipment. The invention also permits a high patty stack.

Figure 2:
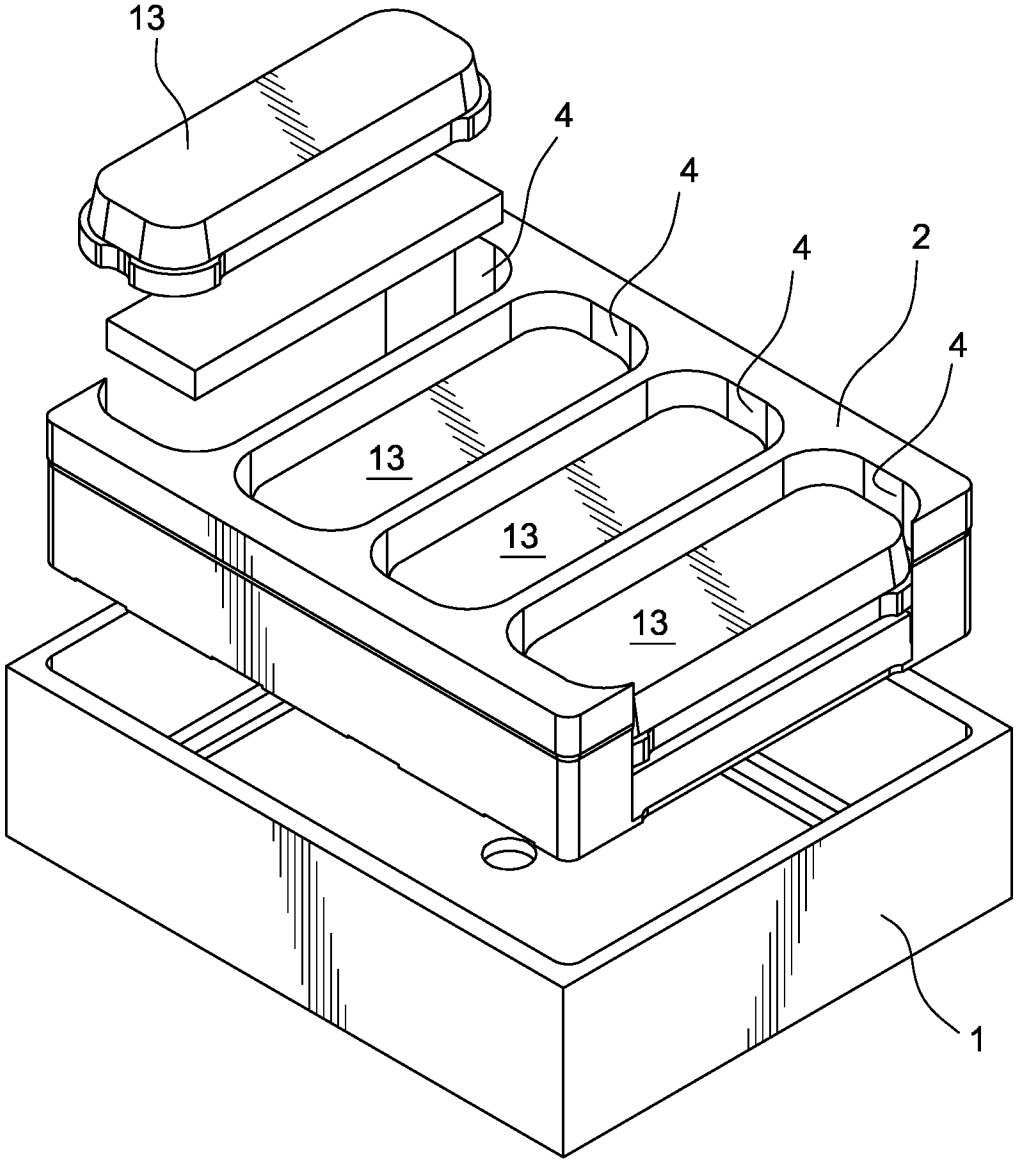
FIG. 2 is an exploded perspective view of the confirmation station in an HFFS machine; and, FIGS. 3*a*-3*c* depict respectively a front, side and perspective view of the spacer.

FIG. 2 shows the confirmation station box 1 and a confirm insert 2 for a package of four adjacent patties. A spacer 13 which is essentially a plastic platen is nested in each aperture 4 in the confirm insert 2. The platen 13 is raised or lowered by an air cylinder 14 to place the landing spot for a patty at a short optimum height for a product drop. With fresh patties, dimensions are tight and a large drop could result in a tilt, causing damage to the package and a possible machine stoppage.

Figure 3C:
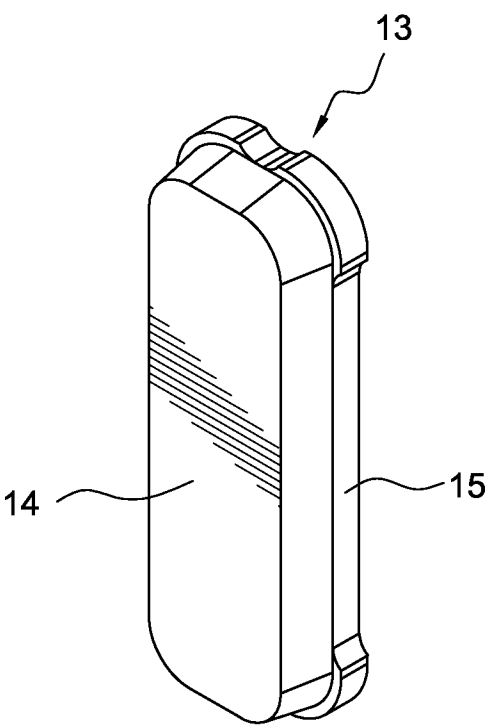
Figure 3B:
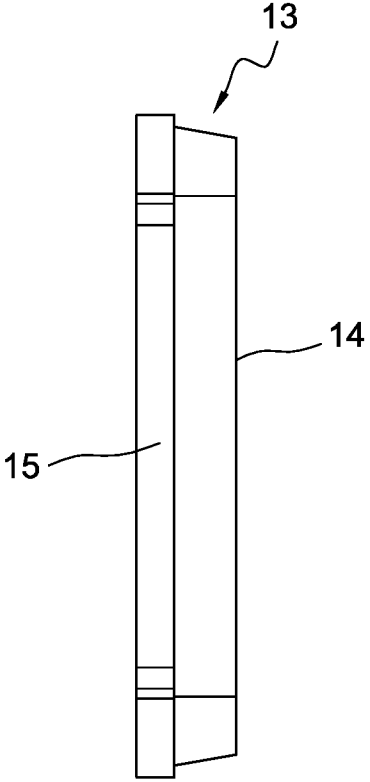
Figure 3A:
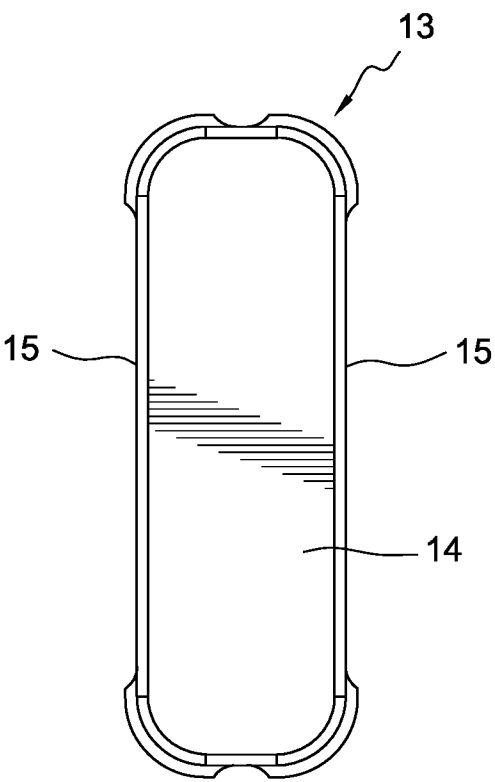

FIGS. 3*a*-3*b* illustrate details on the spacer 13 which includes a base 14 and side walls 15. The package 23 located with confirmation box 1 is designed to accommodate at least four rows of patties up to at least four deep. The spacer 13 lowers as each additional patty is added to the stack from a conveyor. This eliminates dropping the patty a distance into a pocket 31 which could result in tilting the fresh mea patty and damage the package.

Figure 4A:
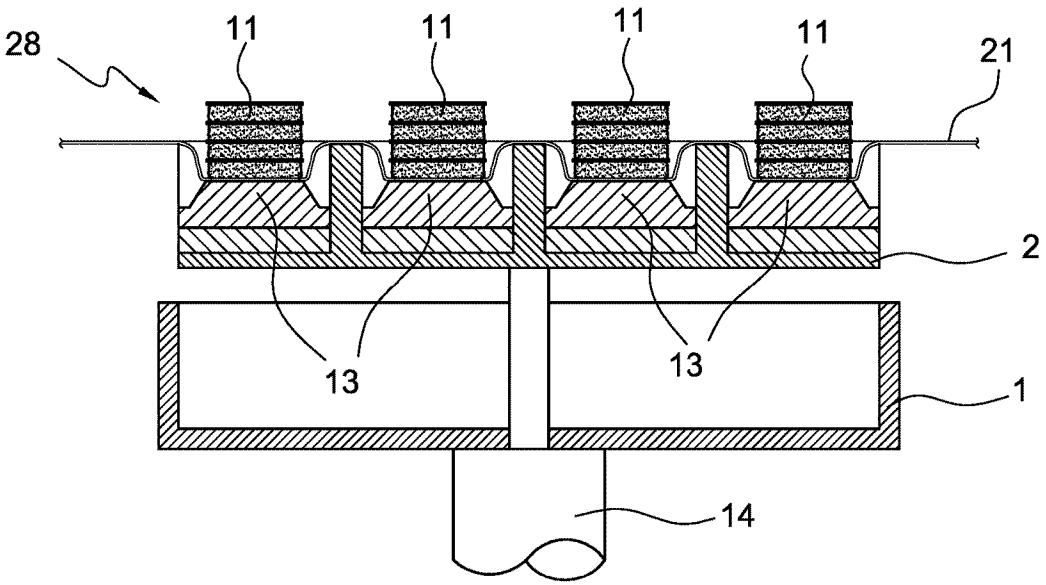
FIGS. 4*a* and 4*b* depict respectively cross-sectional views of the stacked patties and the patties as they appear in a package.
Figure 4B:
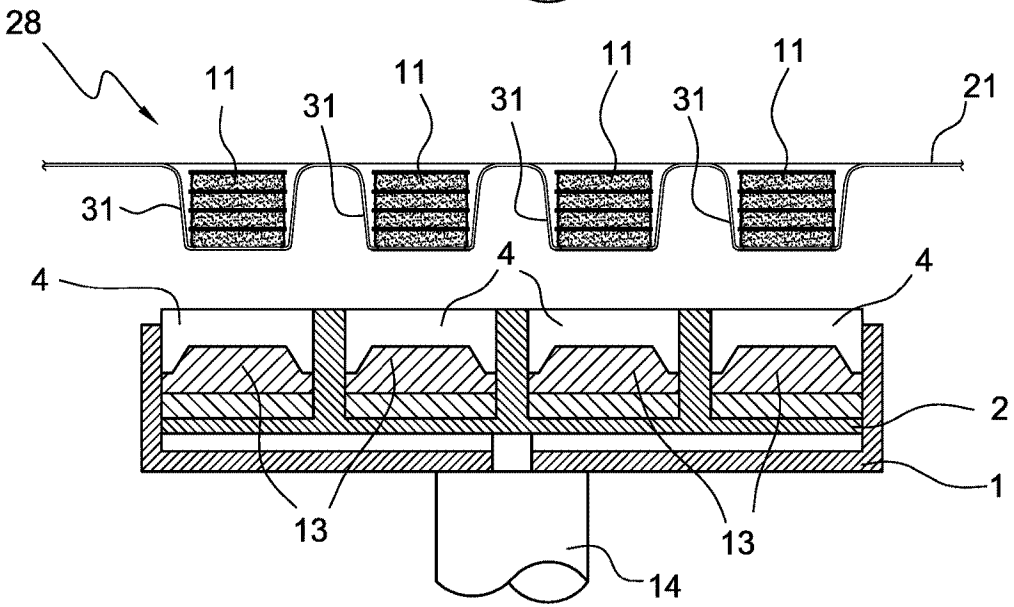

FIG. 4*a* shows the stacked patties 11 as they appear in the confirmation box 1 and FIG. 4*b* shows the package 23 removed from the box 1.

While the invention has been explained by a detailed description of certain specific embodiments, it is understood that various modifications and substitutions can be made in any of them within the scope of the appended claims, which are intended also to include equivalents of such embodiments.

What is claimed is:

1. A dynamic loading device for use in a form fill and seal machine utilizing upper and lower films to seal a package on a main feed conveyor, the package containing a plurality of individually stacked products, the dynamic loading device comprising:

a platen positioned under the package and engaging said lower film;

an air cylinder configured to engage and lift the platen to a top of the package to facilitate loading of the plurality of individually stacked products, the air cylinder further configured to intermittently lower the platen as the products are stacked in the package; and a shuttle conveyor positioned above the package for loading and stacking the products in the package at high speed.

2. A dynamic loading device in accordance with claim 1 wherein the air cylinder engages the platen to raise or lower the platen in incremental steps to provide a close landing place from the shuttle conveyor for the products in the package, and wherein the raising or lowering of the platen is synchronized with the shuttle conveyor and the main feed conveyor.

3. A dynamic loading device in accordance with claim 1 wherein:

the products comprise fresh hamburger patties which are difficult to load into the package and subject to tilting when dropping from the shuttle conveyor.

4. A dynamic loading device in accordance with claim 3 wherein:

the shuttle conveyor for loading and stacking the products comprising the fresh hamburger patties provides a stack of fresh hamburger patties four deep in the package; and four packages are loaded simultaneously using the shuttle conveyor.

5. A dynamic loading device in accordance with claim 3 wherein:

the platen comprises a plastic element conforming to a size of the package and movable in designated increments to minimize a drop of the products from the shuttle conveyor to within the package for stacking purposes, and a movement of the platen is synchronized with a movement of the shuttle conveyor feeding the fresh hamburger patties to the package.

6. A dynamic loading device for use in a form fill and seal machine utilizing upper and lower films to seal a package on a main feed conveyor, the package containing a plurality of individually stacked products, the dynamic loading device comprising:

a platen positioned under the package and engaging said lower film;

means for lifting the platen to a top of the package to facilitate loading of the plurality of individually stacked products and intermittently lowering the platen as the products are stacked in the package; and means comprising a shuttle conveyor for loading and stacking the products in the package at high speed.

* * * * *